US005824929A

United States Patent [19]

Freeland et al.

[11] Patent Number: 5,824,929

[45] Date of Patent: Oct. 20, 1998

[54] MUSICAL INSTRUMENT SELF-TUNING SYSTEM WITH CALIBRATION LIBRARY

[75] Inventors: Stephen J. Freeland, Fort Collins; Gerard F. Hallaren, Littleton; Neil C. Skinn, Fort Collins, all of Colo.

[73] Assignee: Transperformance, LLC, Littleton, Colo.

[21] Appl. No.: 679,080

[22] Filed: Jul. 12, 1996

Related U.S. Application Data

[60] Provisional application No. 60/001,158 Jul. 14, 1995.

[51] Int. Cl. [6] ..... G10D 3/14; G10G 7/02

[52] U.S. Cl. ..... 84/454; 84/DIG. 18

[58] Field of Search ..... 84/454, 297 R, 84/298, 307, DIG. 18

[56] References Cited

U.S. PATENT DOCUMENTS

| | | | |
|---|---|---|---|
| 3,144,802 | 8/1964 | Faber, Jr. et al. | 84/454 |
| 4,044,239 | 8/1977 | Shimauchi et al. | 235/151.3 |
| 4,088,052 | 5/1978 | Hedrick | 84/454 |
| 4,196,652 | 4/1980 | Raskin | 84/453 |
| 4,207,791 | 6/1980 | Murakami | 84/1.01 |
| 4,426,907 | 1/1984 | Scholz | 84/454 |
| 4,584,923 | 4/1986 | Minnick | 84/454 |
| 4,803,908 | 2/1989 | Skinn et al. | 84/454 |
| 4,909,126 | 3/1990 | Skinn et al. | 84/454 |
| 4,958,550 | 9/1990 | Kugimoto | 84/454 |
| 5,009,142 | 4/1991 | Kurtz | 84/454 |
| 5,038,657 | 8/1991 | Busley | 84/455 |
| 5,095,797 | 3/1992 | Zacaroli | 84/455 |
| 5,323,680 | 6/1994 | Miller et al. | 84/455 |
| 5,343,793 | 9/1994 | Pattie | 84/454 |

OTHER PUBLICATIONS

"*Digital Tuning System DTS–1 Owner's Manual*", TransPerformance, Fort Collins, CO, Mar. 1993.

*Primary Examiner*—Brian Sircus
*Assistant Examiner*—Marlon Fletcher
*Attorney, Agent, or Firm*—Greenlee, Winner & Sullivan, P.C.

[57] ABSTRACT

This invention provides a control system for automatically tuning a stringed musical instrument, utilizing a library of calibration functions to tune the instrument in a plurality of operating conditions without recalibration. The operating conditions can include changes in temperature and humidity, different sets of strings made with different materials and gauges, broken strings and the installation of a capo. Calibrations can also be provided for instruments of different makes and models, string lengths, body materials and actuator types. The control system is adapted for use in a stringed instrument having actuators attached to each string for changing the frequency of the string in response to a control signal. Each calibration function relates the frequency of a string to the actuator position of that string. The invention further provides an automatically tuned stringed instrument using the control system, and a method for tuning a stringed instrument.

80 Claims, 11 Drawing Sheets

MUSICAL INSTRUMENT SELF-TUNING SYSTEM WITH CALIBRATION LIBRARY

This application is based on Provisional Application No. 60/001,158, filed Jul. 14, 1995, which is incorporated herein by reference in its entirety.

FIELD OF THE INVENTION

This invention relates to a control system for the automatic tuning of stringed musical instruments under a plurality of operating conditions.

BACKGROUND OF THE INVENTION

Manually tuning a musical instrument can be a difficult and tedious process, usually requiring a considerable amount of time and skill. Although having an automatic tuning system is desirable for ease and convenience, as well as for accuracy, there is another important reason. Frequently, a musician will need to change the tuning of an instrument during a performance or an instrument will go out of tune during a performance. And, during this process, it may be necessary to compensate for a change in an instrument's characteristics. For example, during a performance with a guitar, a string may break or a musician may install a capo between selections. A capo is a device for clamping all strings to a particular fret, thereby increasing the frequencies of all strings by a constant factor. Because of the time required, manually retuning an instrument during a performance is usually unacceptable. One common, although expensive and inconvenient, solution to this problem is to have properly tuned spare instruments available for such occasions. A much better solution is to have a system for automatically tuning an instrument, under a variety of operating conditions, within a length of time short enough to be unnoticed by an audience.

Many different types of automatic tuning systems have been devised. There are open-loop systems which drive a tuning actuator to a predetermined position for each desired frequency. These have the advantage of being able to change tuning silently, actuator to a predetermined position for each desired frequency. These have the advantage of being able to change tuning silently, and therefore unnoticed, during a performance. However, they have the disadvantage of being only as accurate as the predicted relationship between the frequency of the tone produced by the instrument and the actuator position. There are closed-loop systems which measure the frequency of the tone produced by the instrument, compare it to a desired value, and use the result of the comparison to control an actuator which tunes the instrument. This technique is accurate in that it directly controls the frequency of the instrument and is independent of other factors which affect frequency. However, it has the disadvantage that an audible tone must be produced while the instrument is being tuned; and that audible tone generally precludes tuning during a performance. Some stringed instrument systems, because of interactions between strings, sequentially tune each string and then iterate to compensate for the interactions. Others tune selected strings, or all strings, simultaneously and then iterate. These techniques require producing a tone, taking a frequency measurement, estimating and executing an actuator movement, then taking a new frequency measurement and repeating the process until the frequency produced is sufficiently close to the desired frequency. Other systems measure the tension of (actually, the force applied to) a string and compare the measured value with a desired value to produce an actuator control signal. Although the string tension method does not require a tone to be produced while tuning, it does require a known and stable relationship between string tension and frequency. Satisfying this relationship requirement is difficult because frequency also depends on string length and mass per unit length as well as other factors.

A typical stringed musical instrument has a semi-rigid structure which changes form slightly when string tensions in the instrument are adjusted during tuning. A change in form due to the adjustment of one string therefore affects the frequencies of the remaining strings. Temperature and humidity also affect the form, and the frequencies, of the instrument in more subtle ways.

A system which compensates for the effect of adjusting one string on the frequencies of the remaining strings, described in U.S. Pat. Nos. 4,803,908 and 4,909,126 to Skinn et al. which are incorporated by reference herein in their entirety, involves the use of a calibration function which relates the position of each actuator to the frequencies produced by all the instrument's strings. Creating the calibration function involves the measurement of frequencies at multiple positions of each actuator and, through regression techniques, relating the position of each actuator to not only the frequency of its own string but to the frequencies of the other strings as well. The use of regression techniques provides the advantage that a priori knowledge of the detailed characteristics of the instrument being tuned is not required. Also, the calibration function can be updated by recalibration as the instrument ages, or as environmental or other changes occur. Using a calibration function generated from the particular instrument being tuned permits open-loop, and therefore silent, tuning with accuracy comparable to that of closed-loop systems.

None of the previously described open-loop systems provides for tuning an instrument whose configuration or characteristics have changed significantly after the system's calibration. Yet it is common for such changes to occur. In the guitar example, if a string breaks, or if a string having a different gauge is installed, the instrument undergoes a substantial change in its tuning characteristics. Because of the bowing of the neck of the guitar, as well as other factors, the tensions in the individual strings interact. That is, a change of tension in one string changes the tension in the other strings. A more important effect is that such factors change the relationship between actuator position and string vibration frequency. Similarly, because the installation of a capo changes the effective length of the strings, the relationship between actuator position and vibration frequency is changed. All of the previously described open-loop systems require a recalibration before tuning when an instrument changes significantly. Because of the time required and the sounds produced, recalibration before an audience is impractical.

It is therefore an object of this invention to provide for automatically tuning a musical instrument having changing characteristics without recalibration. A further object of the invention is to provide for generating and storing for later use multiple calibration functions each providing for tuning the instrument under a different set of operating conditions.

SUMMARY OF THE INVENTION

The invention is a control system having a library of calibration functions for automatically tuning a stringed musical instrument wherein each calibration function provides for tuning the instrument under a different set of operating conditions or a different instrument configuration.

The control system enables a musician to tune an instrument which has undergone substantial changes in its configuration or in the environment in which it is being used, during a performance in a manner unlikely to be noticed by the audience.

The invention includes a library of stored calibration functions. Each calibration function results from calibrating the system for a different set of conditions. Different operating conditions include different temperature and humidity environments, broken strings, the installation of a capo, and the use of different string types. The library can also include calibrations for different makes and models of instruments so that the control system can be installed in different instruments. For example, a single calibration library can include sub-libraries of calibrations for instruments with different play lengths of the strings, different body materials (e.g., wood or metal), different instrument types (e.g., guitar or bass), and different actuator types having, for example, different motors, springs or levers. The calibration sub-library for each kind of instrument can include calibrations for different operating conditions, as described above.

The control system uses a calibration function to generate control signals from a set (one per string) of desired frequencies. The control signals are sent to actuators which use the signals to adjust the instrument.

The control system optionally includes a calibration feature for obtaining frequency information from the instrument and using that information to generate, or modify, the calibration functions.

In the preferred embodiment, to compensate for string interactions, the system uses a calibration function which generates each actuator position in response to the entire set of desired frequencies. Also, in the preferred embodiment, actuator positions for more than one set of target frequencies can be generated from each calibration function.

BRIEF DESCRIPTION OF THE DRAWING

The above-mentioned and other features and objects of the invention and the manner of attaining them will become more apparent and the invention itself will best be understood by reference to the following description of embodiments of the invention taken in conjunction with the accompanying drawing a brief description of which follows.

FIG. 6, comprising

DESCRIPTION OF THE PREFERRED EMBODIMENT

Figure 1:
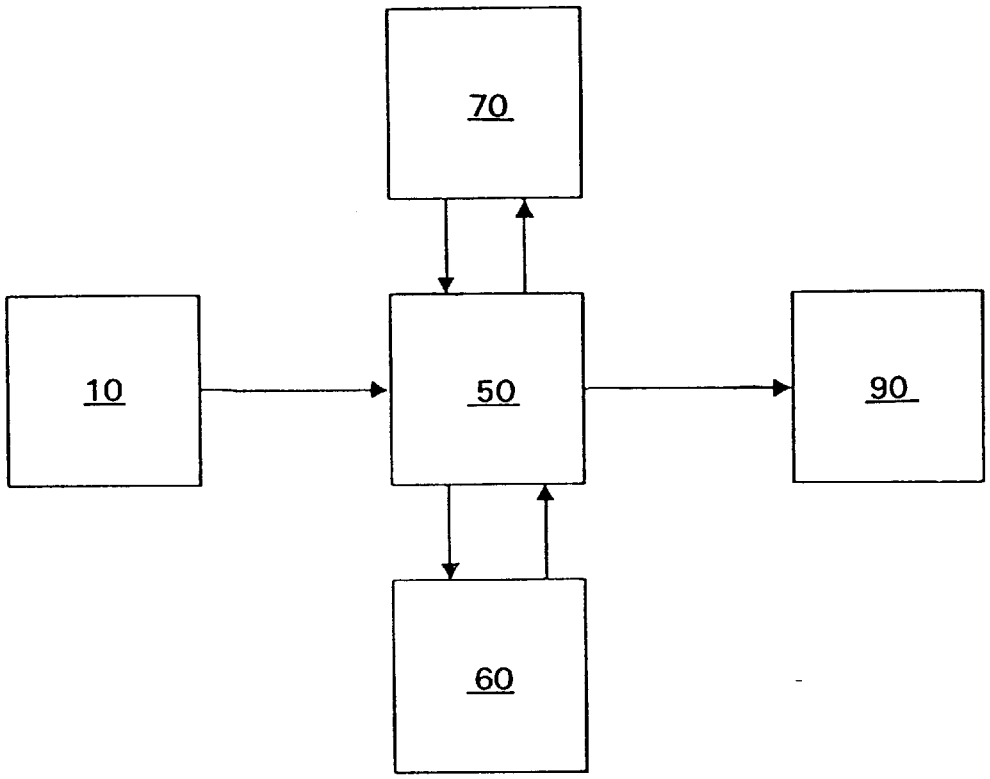
FIG. 1 is a block diagram of an automatic tuning system utilizing this invention.

When reference is made to the drawing, like numerals indicate like parts and structural features in the various figures. Also, hereinafter, the following definitions apply:

actuator: a device for changing a frequency of the instrument in response to a control signal;

actuator position: a particular actuator output affecting frequency, such as angle, force, pressure or linear position;

calibration function: any function relating frequency and actuator position and may be represented by, and stored as, a set of coefficients for a specific mathematical expression or as values in a look-up table;

calibration library: a plurality of stored calibration functions;

target frequency: a desired frequency to which a string is to be tuned;

tuning configuration: a set of target frequencies (one per string) which comprise a particular target tuning of an instrument;

cents: a measure of frequency in which 100 cents equal one half-step; i.e., 1200 cents equal one octave; and wherein the terms frequency and period are regarded as equally unambiguous measures of frequency.

The invention is a control system for automatically tuning a stringed musical instrument, utilizing a library of calibration functions to tune the instrument in a plurality of operating conditions without recalibration. The operating conditions can include changes in temperature and humidity, different sets of strings made with different materials and gauges, different string setups, broken strings and the installation of a capo. As will be evident to the skilled artisan, calibration functions for changes in other instrument conditions can be included in the library. The library can include functions suitable for changes in just one of these instrument conditions, for example the installation of a capo, or it can include a variety of functions which allow for more than one type of change in conditions, for example the installation of a capo or breaking a string. The calibration functions can include instrument conditions which are simultaneous combinations of more than one instrument condition, for example using a different set of strings and installing a capo. Examples of members of a calibration library and the associated operating conditions are listed below. In this list, unless other conditions are stated, the instrument is in a normal environment, has string set "A" of particular materials and gauges, and has no capo or broken strings.

Function 1: Normal conditions

Function 2: A warm, humid environment

Function 3: A cool, dry environment

Function 4: A broken string in a first position

Function 5: A broken string in a second position

Function 6: A capo installed at the first fret

Function 7: A capo installed at the second fret

Function 8: String set "B"

Function 9: A capo installed at the second fret, string set "B"

Function 10: A capo installed at the second fret, string set "B", broken string in a first position Function 11: A capo installed at the second fret, string set "B", broken string in a first position, a warm, humid environment The library can contain calibration functions, or entire sub-libraries, for different makes and models of instruments. In the case of a guitar this can also include, for example, different neck lengths, fret configurations, bridges, body materials or actuators. The library can also contain calibrations for different types of instruments, such as basses, resophonic guitars and steel guitars. In this way a standard control system can be manufactured and installed in a variety of instruments. The use of a single standard control system for a group of instruments also simplifies repairs and maintenance.

A functional block diagram of the control system is shown in FIG. 1. Transducer 10 is coupled to processor 50 which is in turn connected to actuator 90. Memory 60 is also connected to processor 50. Processor 50 receives input from and provides output to the operator via operator interface 70. Although depicted here to illustrate its use in calibration of the system, transducer 10 is not an essential part of each system if the calibration functions are factory generated. The transducer is necessary only when the calibration functions are generated or modified.

FIG. 1 depicts simplified functional blocks of the control system. It should be recognized that the functions may be implemented in other ways familiar to those with ordinary skill in the art. For example, both the processing and memory functions could be performed in the processor.

To generate a calibration function, transducer 10 produces an electrical signal representing a sound produced by the instrument (not shown). Processor 50 receives the transducer signal from transducer 10 and generates calibration functions which are stored in memory 60 for later use in tuning the instrument. However, if the calibration is performed at a factory, either on the individual instrument or on a reference instrument having similar characteristics, then transducer 10 and the calibration portion of processor 50 need not be a part of the control system of the individual instrument. It is to be understood that the process of generating a calibration function need not be performed by the individual instrument having the control system of this invention, but can instead be performed on a reference instrument and the resulting calibration functions can be loaded into the control system of the individual instrument.

When tuning the instrument, processor 50 obtains a calibration function from memory 60 and utilizes it to generate, from a set of target frequencies, control signals which are utilized by actuator 90 to tune the instrument.

A calibration function is any function relating frequency to actuator position. In a preferred embodiment a single calibration function can be used to access a plurality of tuning configurations, and the instrument can switch between tuning configurations in the middle of a song without the need for additional tuning.

For a control system to automatically tune all of the strings of an instrument without iteration under a wide range of conditions, the use of empirically derived calibration functions is nearly always necessary. The vibrating frequency of a guitar string depends not only on the position of the actuator controlling the tension in that string but also on the effective length and mass of that string, the tension in all the other strings, the stiffness of the neck of a guitar, etc. The combined effects of these variables on frequency are extremely difficult to predict and therefore the preferred control system uses calibration functions of empirically determined shapes.

Figure 5:
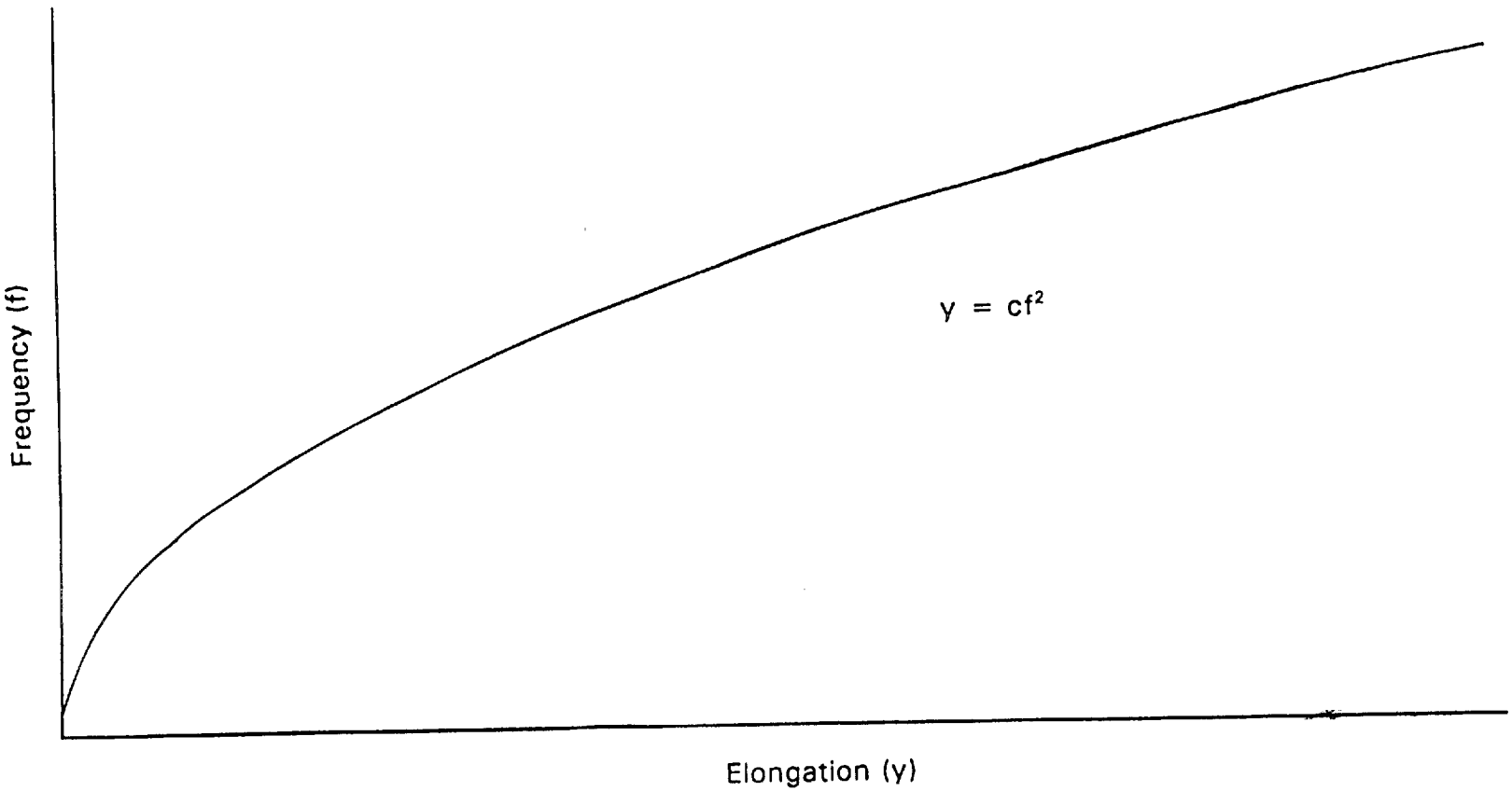
FIG. 5 is a plot of frequency versus elongation position for a single string.

A calibration function can have any form which relates actuator position to frequency for the instrument being tuned. For example, in the case of a stringed instrument, a simple model relating elongation and frequency of a vibrating string is plotted in FIG. 5 and described by the equation:

$$y = 4\frac{ML^3}{EA} f^2 \tag{1}$$

where y is the elongation, K is the mass per unit area, L is the length, E is the modulus of elasticity, A is the cross sectional area, and f is the frequency of the string. However, this expression only includes string attributes. Where the elongation y of a string is changed, additional system related factors become involved and the relationship between actuator position and frequency is usually considerably more complex than indicated by this simple function. Furthermore, the values of the string attributes themselves are difficult to know precisely due to manufacturing tolerances. It is therefore important to have a system for producing calibration functions with as many terms as necessary to adequately describe the characteristics of the instrument.

Any general (continuous, single valued, etc.) function g(x) can be represented by the Maclaurin series in the following equation:

$$g(x) = g(0) + xg'(0) + \frac{x^2}{2!} g''(0) + \frac{x^3}{3!} g'''(0) + \ldots + \frac{x^n}{n!} g^{(n)}(0) +$$

By recognizing that g(x) and its derivatives $g^{(n)}$ (x) are constants for x=0 and substituting f for x and x for g(x) the function can be rewritten as:

$$x = a + bf + cf^2 + df^3 + \tag{2}$$

which relates actuator position x to vibrating string frequency f. Each different set of coefficients a, b, c, . . . , produces a different function. The use of the Maclaurin series permits multiple calibration functions to be defined and stored as multiple sets of coefficients.

Although Eq. 2 in its most general form is an infinite series, most calibration functions are relatively simple and only a few terms are needed to obtain the accuracy required. For example, in the preceding model, described by Eq. 1, only the third ($f^2$) term is required. In the preferred embodiment, the values of coefficients a, b, c, etc., of the calibration function are empirically obtained by a calibration process performed either on the individual instrument or a reference instrument. In the calibration process, a minimum number n of frequencies $f_i$, where $1 \leqq i \leqq n$ and n is the number of unknown coefficients, are measured at n different actuator positions $x_i$. Then each pair of values, $x_i$ and $f_i$ is sequentially inserted into Eq. 2, resulting in n equations with n unknowns which can be solved by conventional techniques for the unknown values of the coefficients. The number n is the minimum number of measurements necessary to solve for the desired number of coefficients; more measurements may be needed to obtain statistically valid values for $f_i$ if the measurements are not repeatable.

After the coefficients in Eq. 2 have been determined by the calibration process, an actuator position x can be computed for any given target frequency f within the tuning range of the instrument. Then, the value x can be used to control the actuator and tune the instrument to the frequency f. In obtaining a calibration function f is the measured frequency at a selected actuator position; when using the calibration function f is a selected target frequency used to estimate the necessary actuator position.

Since the calibration function has as many empirically derived terms as necessary to accurately describe the characteristics of the instrument, it can predict an actuator position which will yield the desired frequency within a few cents over the entire tuning range of the instrument. However, as an option providing greater accuracy, the following "touch-up" calibration yields the desired frequency within ±2 cents.

In the event that the instrument's characteristics change slightly after the initial calibration and all tuning configurations are affected, or if the frequency produced by the instrument for a particular tuning configuration is incorrect, the calibration can be modified or "touched up" by the following methods.

Figure 6A:
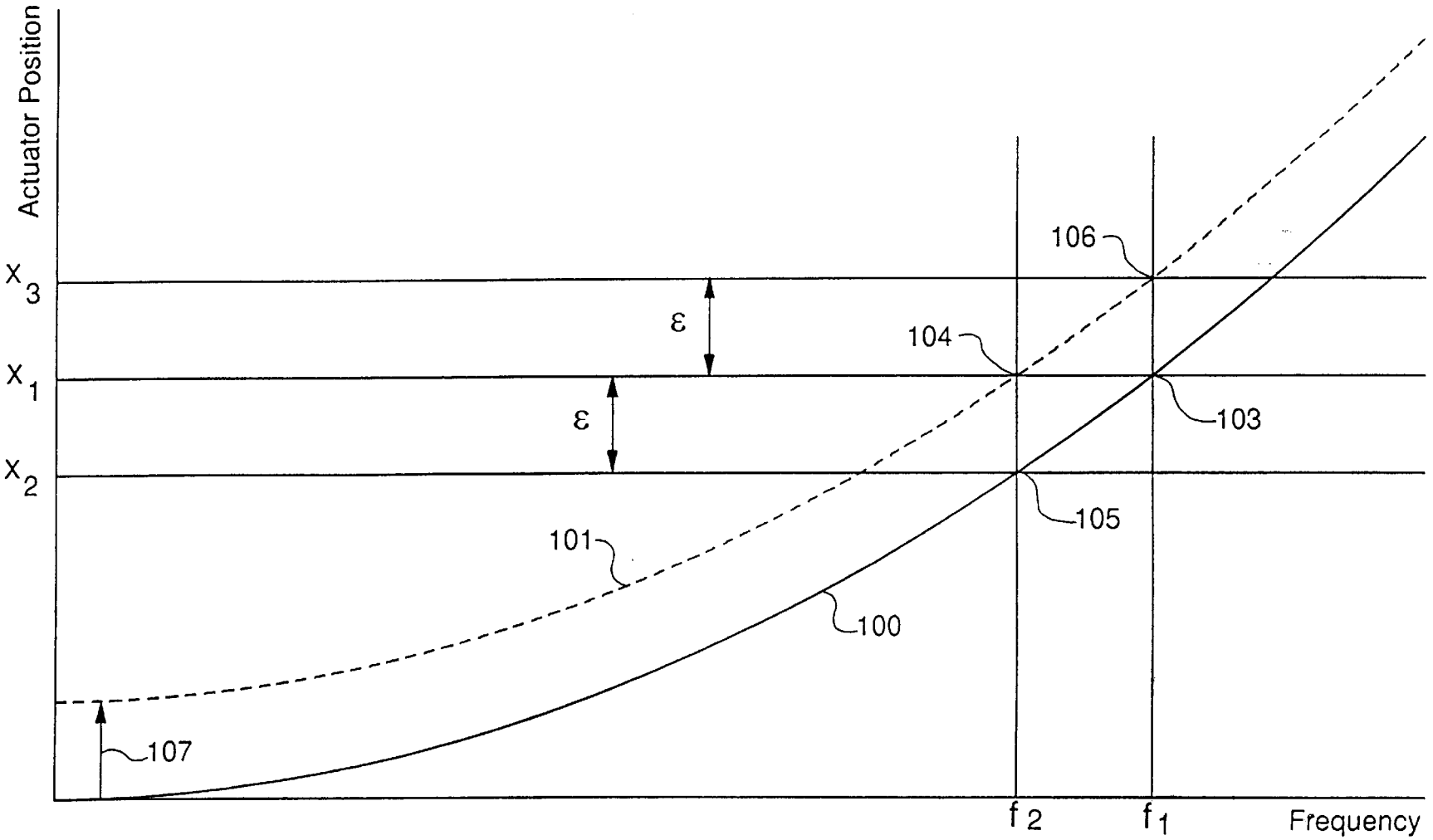
FIGS. 6A–C, shows plots of actuator position versus frequency for a single string showing "touch-up" calibrations.

Referring to FIG. 6A, curve 100 represents the original system characteristic function, described by the calibration function, and curve 101 represents a new (changed) characteristic function. In this example, curve 101 is a simple translation in actuator position x of curve 100 representing, for example, a slip in the position of a tuning peg or the stretching of a string. During touch-up, the actuator is driven in a normal tuning operation to a position $x_1$ corresponding to a target frequency $f_1$ indicated by point 103 on curve 100. The instrument is strummed once and the actual frequency, $f_2$ is measured. On the new characteristic function, curve 101, frequency $f_2$ corresponds to point 104. Using the original calibration function, actuator position $x_2$ is computed from the measured frequency $f_2$ as indicated by point 105. The difference between the two values of actuator position $x_2-x_1=\epsilon$ is computed. This value of $\epsilon$ is used to modify the constant term a in Eq. 2 and therefore affects the computed actuator position for all tunings thereafter. Modifying the constant term in Eq. 2 translates original calibration function 100 vertically upward by the value $\epsilon$, as indicated by arrow 107, to create a new calibration curve which, in this example, corresponds to new characteristic function 101. Using the new calibration function, to achieve target frequency $f_1$ the calculated actuator position is $x_3$, as shown by point 106. In a preferred embodiment $\epsilon$ is obtained for "Standard Tuning" (EADGBE). However, it can alternatively be obtained in a different tuning configuration. In the case when the frequency of only a particular tuning configuration is incorrect, the value of $\epsilon$ is measured and stored for that tuning configuration.

Figure 6B:
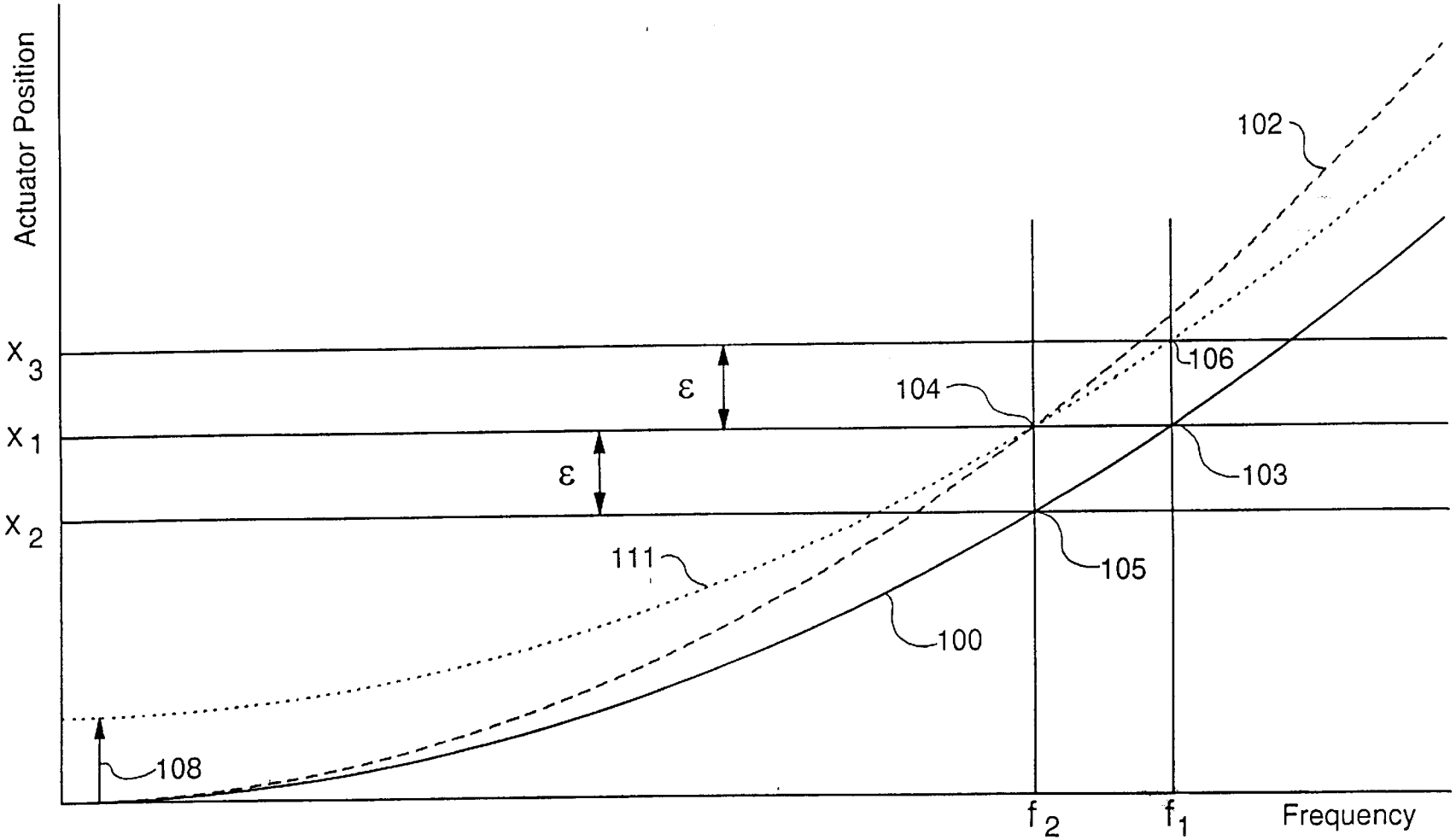

Generally changes in the system calibration are more complex than the simple shift shown in FIG. 6A. Referring to FIG. 6B, curve 100 again represents the original system characteristic function, described by the calibration function, but curve 102 represents another new (changed) system characteristic function. In this case, the new function is not a translation of the original function but is a function having a different curvature. Such a change in the function could be the result of a change in the stiffness of the structure of the instrument, for example. The touch-up in this case can be performed in the same way as in the previous case, that is by translating curve 100 vertically upward, as indicated by arrow 108, to superimpose on curve 102 at point 104. The result is curve 111. This touch-up is accurate only in the neighborhood of the point 104 since curve 111 deviates from curve 102 as the distance from point 104 increases. Using new calibration curve 111, to achieve target frequency $f_1$ the calculated actuator position is $x_3$, as indicated by point 106. Note that point 106 does not fall exactly on new system characteristic function 102, and so the actual touched-up frequency differs slightly from the target frequency.

Figure 6C:
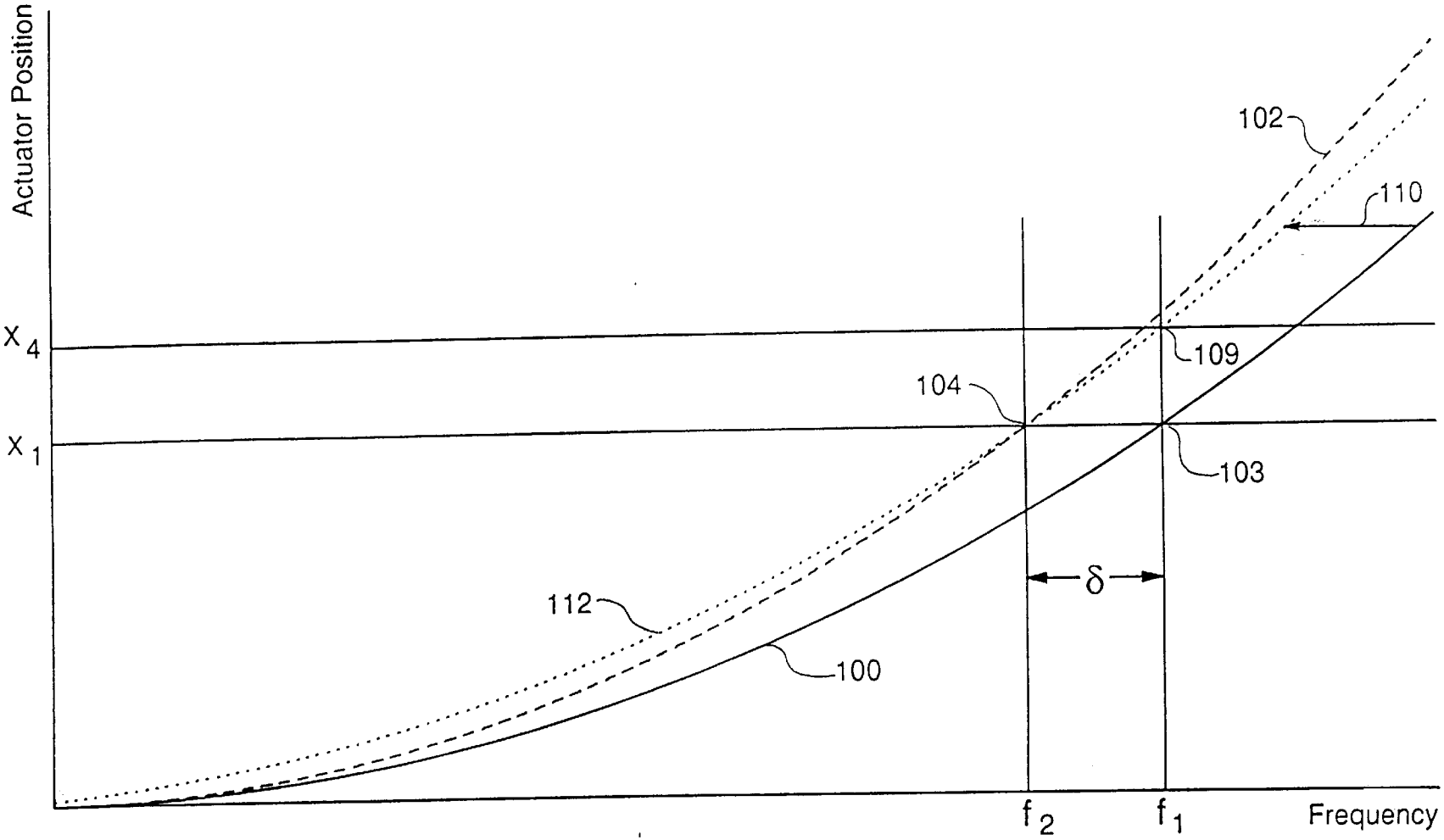

An alternative method of touching-up the calibration is shown in FIG. 6C. Again, curve 100 is the original characteristic function and curve 102 is the new characteristic function. The target frequency is $f_1$, but the frequency actually obtained is $f_2$. Instead of computing a position $x_2$ from the frequency $f_2$, the difference between the measured and the target frequencies $\delta=f_2-f_1$ is computed and stored during the touch-up. New calibration curve 112 is formed by translating curve 100 horizontally to the left by the value 6 as indicated by the arrow 110. The result is indicated by the curve 112. Using new calibration curve 112, to achieve target frequency $f_1$ the calculated actuator position is $x_4$, as indicated by point 109. Note that point 109 does not fall exactly on new system characteristic function 102. The relative accuracy obtained by sliding the calibration function curve horizontally compared to vertically depends on the shape of the changed system characteristic curve (e.g., curve 101 versus curve 102). Both methods provide excellent tuning accuracy. In general, the calibration function is modified based on the difference $\delta$ between the measured and target frequencies $(f_2-f_1)$ or the difference $\epsilon$ between the corresponding actuator positions $(x_2-x_1)$. A combination of horizontal and vertical translations can also be used. Although a linear approximation can be used for touch-up, the preceding methods provide greater accuracy because the calibration function itself, instead of a linear approximation, is used to compute the value of $\epsilon$ or $\delta$. Since a calibration function is in general non-linear, the combination of using the calibration function itself and evaluating it at a point already very close to the desired position provides a way of obtaining a very accurate final adjustment of the calibration.

An alternative to the previously described touch-up method utilizes a closed-loop servo technique. In this method, the actuator is driven to the position $x_1$ using a calibration function as previously described. Then the instrument is strummed and the difference between the actual frequency of each string and the target frequency of that string is used to generate an error signal. A control signal is generated from the error signal and is applied to the actuator drive circuits. The actuator then moves to reduce the error signal to zero as in a traditional closed-loop servo system. In this case, string interactions and other factors affecting frequency need not be considered because the frequency of each string is independently moved to its desired value by the servo loop even though its environment may be changing. When all actuators have settled at their final positions, the resulting position values are used to modify the calibration function or stored for subsequent use in tuning the instrument. In this invention, a closed-loop servo technique can also be used in the process of generating a calibration function having the form of either a mathematical function or a look-up table. The details of the implementation of a servo system providing the function described are readily available in textbooks and catalogs and are familiar to those skilled in the art of control systems.

The calibration function described above is adequate for a single string. However, a practical stringed instrument has multiple strings. In this case, the previously described function is expanded to include the other strings as follows:

$$x_1 = a_1 + b_{11}f_1 + c_{11}f_1^2 + d_{11}f_1^3 + \ldots + b_{12}f_2 + c_{12}f_2^2 + d_{12}f_2^3 + \ldots + b_{13}f_3 + c_{13}f_3^2 + d_{13}f_3^3 + \ldots + \ldots \quad (3)$$

$$x_2 = a_2 + b_{21}f_1 + c_{21}f_1^2 + d_{21}f_1^3 + \ldots + b_{22}f_2 + c_{22}f_2^2 + d_{22}f_2^3 + \ldots + b_{23}f_3 + c_{23}f_3^2 + d_{23}f_3^3 + \ldots + \ldots \quad (4)$$

where the subscripts refer to the strings and associated actuator positions.

The one-dimensional (single actuator, multiple positions) calibration procedure, described for a single string, is expanded into two dimensions (multiple actuators, multiple positions) as required for multiple strings. By storing the actuator position data $x_{jk}$ and the corresponding frequency data $f_{jk}$ for each combination of actuators j (connected to strings j) and positions k, enough independent equations to solve for the unknown coefficients can be generated. The equations can be solved by conventional techniques, including matrix, regression and statistical methods, and the resulting coefficients stored in a non-volatile memory. The calibration process is repeated for as many sets of operating conditions as desired and the resulting calibration functions are stored in memory.

The use of the Maclaurin series is a general solution which permits the synthesis of a calibration function of any form. However, if the form of the function is known in advance, e.g. Eq. 1, that function can be substituted for the series. The same kind of calibration process is performed and the task is easier with fewer terms and fewer coefficients than required for a series. Also, as another alternative, a Taylor series as in the following expression:

$$x = g(f_0) + (f - f_0)g'(f_0) + \frac{(f - f_0)^2}{2!} g''(f_0) + \frac{(f - f_0)^3}{3!} g'''(f_0) + \ldots$$

could be used in place of the Maclaurin series. In this case, the calibration function uses the difference between two frequencies, for example a target frequency and an actual frequency, instead of a single frequency, as an argument during calibration.

Although the calibration functions in the preceding descriptions are empirically derived mathematical equations, the invention may use calibration functions of many other forms. For example, the calibration functions can be based on theoretical models instead of empirical data and can be in the form of look-up tables, one for each tuning configuration, instead of mathematical functions.

The control system can be coupled to an instrument condition sensor to monitor frequency or other signals during play of the instrument for certain types of changes instrument conditions. For example, if a stringed instrument's frequencies or sound levels change in a recognizable pattern when a particular string breaks, the control system can automatically switch to an appropriate calibration function to provide the operator with a tuned instrument in a practically instantaneous manner despite the broken string. Similarly, monitoring other signals such as lo the tension or electrical continuity of the strings, or the effect of the strings on an optic, electric or magnetic field, can be used to determine when a string breaks. In the case of detecting an installed capo, the instrument condition sensor can measure electrical contact between a string and a fret. When a capo is installed the frequency of each string increases by a constant factor compared to the open-string (no capo installed) frequency. The increase in frequency can be used to sense the installation of a capo, as described in greater detail in concurrently filed U.S. patent application Ser. No. 08/679,071, entitled "Musical Instrument Self-Tuning System With Capo Mode," Attorney Docket No. 64-94, which is incorporated by reference herein in its entirety. The calibration function can be selected automatically by the control system in response to an instrument condition sensor or can be selected manually by the operator.

Figure 2:
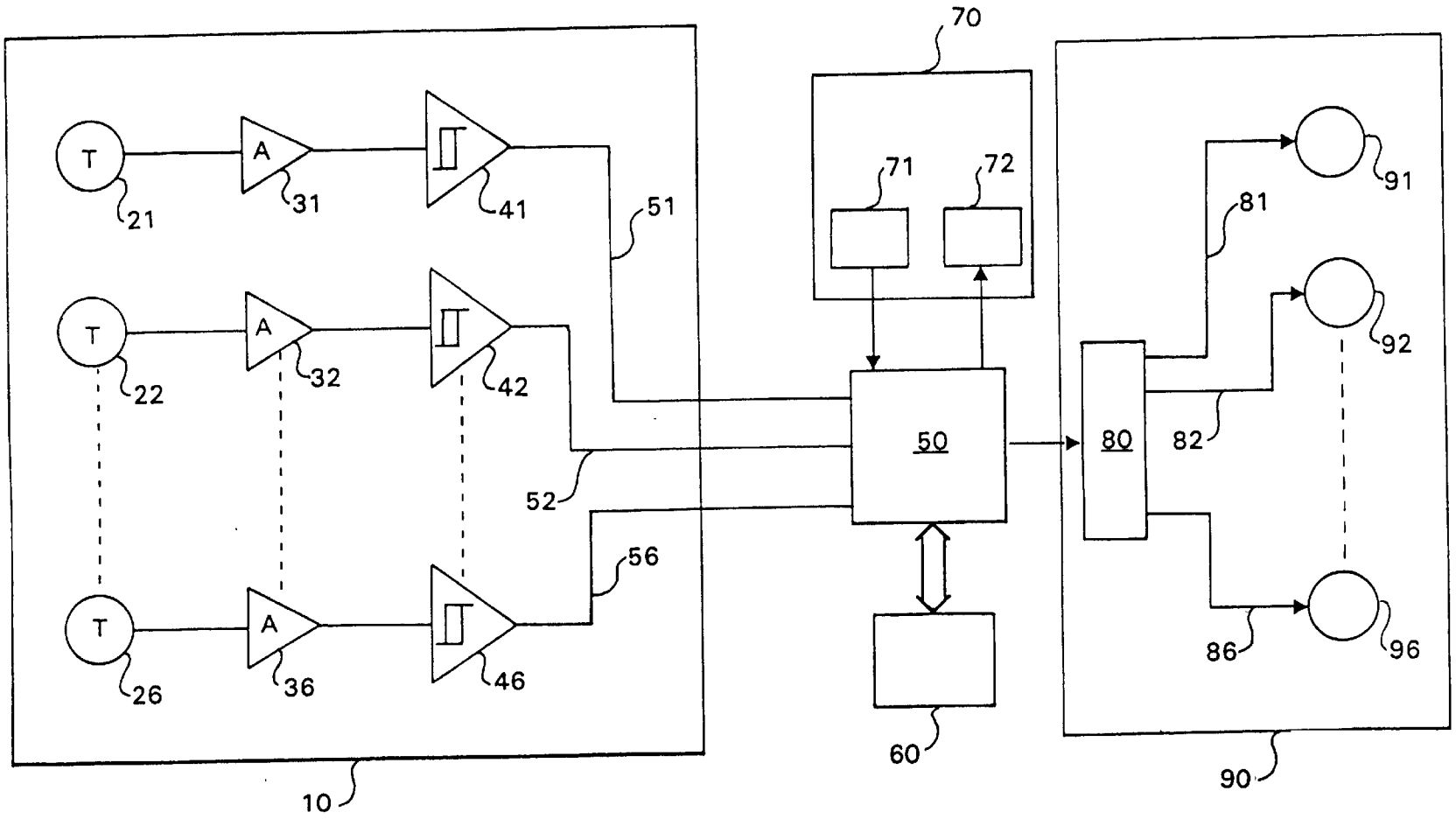
FIG. 2 is a block diagram of a preferred embodiment of an automatic tuning system for a stringed instrument utilizing this invention.

FIG. 2 is a block diagram of a preferred embodiment used in a stringed instrument. Referring to FIG. 2, transducer 21 is connected through amplifier 31 to Schmitt trigger 41 which is connected to processor 50. In a similar manner, transducers 22–26 are connected through amplifiers 32–36 to Schmitt triggers 42–46 which are also connected to processor 50. Switch panel 71, display 72 and memory 60 are also connected to processor 50. Processor 50 is connected to actuator driver circuit 80 which is connected to actuators 91–96.

During calibration, when the string associated with transducer 21 is caused to vibrate, for example by strumming, an electrical signal having the frequency of the vibrating string is generated by transducer 21 and applied to the input of amplifier 31. Amplifier 31 has a low-pass frequency characteristic with a cutoff frequency chosen to permit amplification of the fundamental frequency of the string while reducing the effect of harmonics. The amplified signal is applied to the input of Schmitt trigger 41 which is configured to produce a binary output signal having the same frequency as the vibrating string. The signal paths for the other strings, transducers 22–26, amplifiers 32–36, and Schmitt triggers 42–46 operate in the same way.

Processor 50 in a digital computer utilizes a clock signal and a counter to accurately measure the periods of each of the binary signals supplied by Schmitt triggers 41–46. The period measurements can be performed either concurrently or consecutively since only one period of a few milliseconds in duration is needed for each measurement. Also, since the time required for each measurement is small, the measurements can be replicated for greater accuracy if necessary.

Processor 50 utilizes switch panel 71, non-volatile memory 60 and display 72 for input, output and storage functions. Switch panel 71 provides a way for an operator to enter commands and data for controlling the system. Memory 60 provides storage for instructions and data. Display 72 provides for processor 50 to communicate various forms of information (e.g. status, prompts, or data) to the operator.

Figure 9:
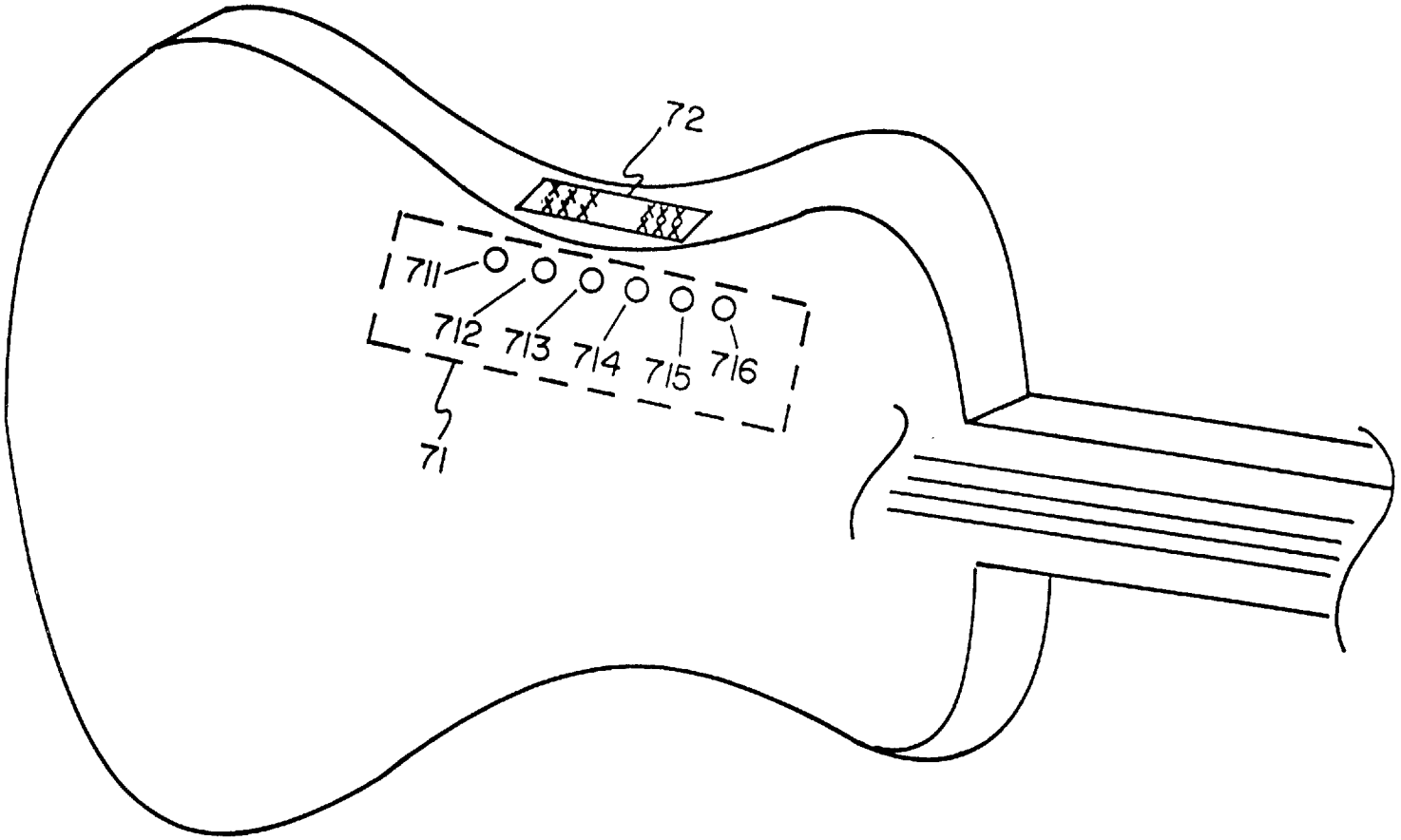
FIG. 9 is a diagram showing more details of the control panel and display used in the system shown in FIG. 2.

FIG. 9 shows a preferred embodiment of switch panel 71 and display 72 of FIG. 2 in more detail. (See also Digital Tuning System DTS-1 Owner's Manual (1992), TransPerformance Corporation, Fort Collins, Colo., which is incorporated by reference herein in its entirety.) Switch panel 71 comprises six push buttons 711–716 located on the front face of the instrument. The six push buttons consist of four arrow buttons, a select (SEL) button, and an END button. Display 72 is a liquid crystal display (LCD), having two rows of 24 characters each, located on the top of the instrument where it is easily visible to the operator. In operation the LCD is normally partitioned into a menu containing four regions of 12 characters each, one of which is blinking. In effect, the LCD acts as a four region window into a larger hidden two-dimensional menu area of similar regions. By use of the arrow buttons, the blinking region can be moved within the window, and the window can be moved throughout the area by attempting to move the blinking region beyond a window border. Attempting to move beyond the edge of the area causes the window to wrap around to the opposite side of the area. An item from the menu is selected by moving the blinking region to the item desired and pressing the SEL button. Selecting a menu item may either execute that item or bring up a submenu as appropriate. Pressing the END button returns the display to the previous menu. The combination of switches 711–716 and display 72 permits selection of modes, such as PLAY, TOUCH-UP and EDIT, as well as selection and modification of stored calibration functions and stored tuning configurations. For example, the EDIT mode permits the operator to edit stored sets of target frequencies and to enter new sets of target frequencies. FIG. 9 shows one functional embodiment of an operator interface. A greater number of switches or a larger display can allow faster selection and use of the operating modes. A feature of the present invention which is not included in the 1992 Manual is the ability to use the switch panel to select a calibration function.

During calibration, processor 50 receives frequency signals from transducer 10 and, using instructions from switch panel 71 and memory 60, generates and stores calibration functions. During tuning operations, processor 50, utilizing a previously stored calibration function, generates actuator control signals which are supplied to actuator driver 80.

Actuator driver 80 generates driving signals which cause actuators 91–96 to move to increase or decrease the tension in each of the strings of the instrument.

It should be noted that FIG. 2 describes a preferred embodiment and that those skilled in the art will recognize other possible implementations of the invention. Some examples are described in the following paragraphs.

Figure 3:
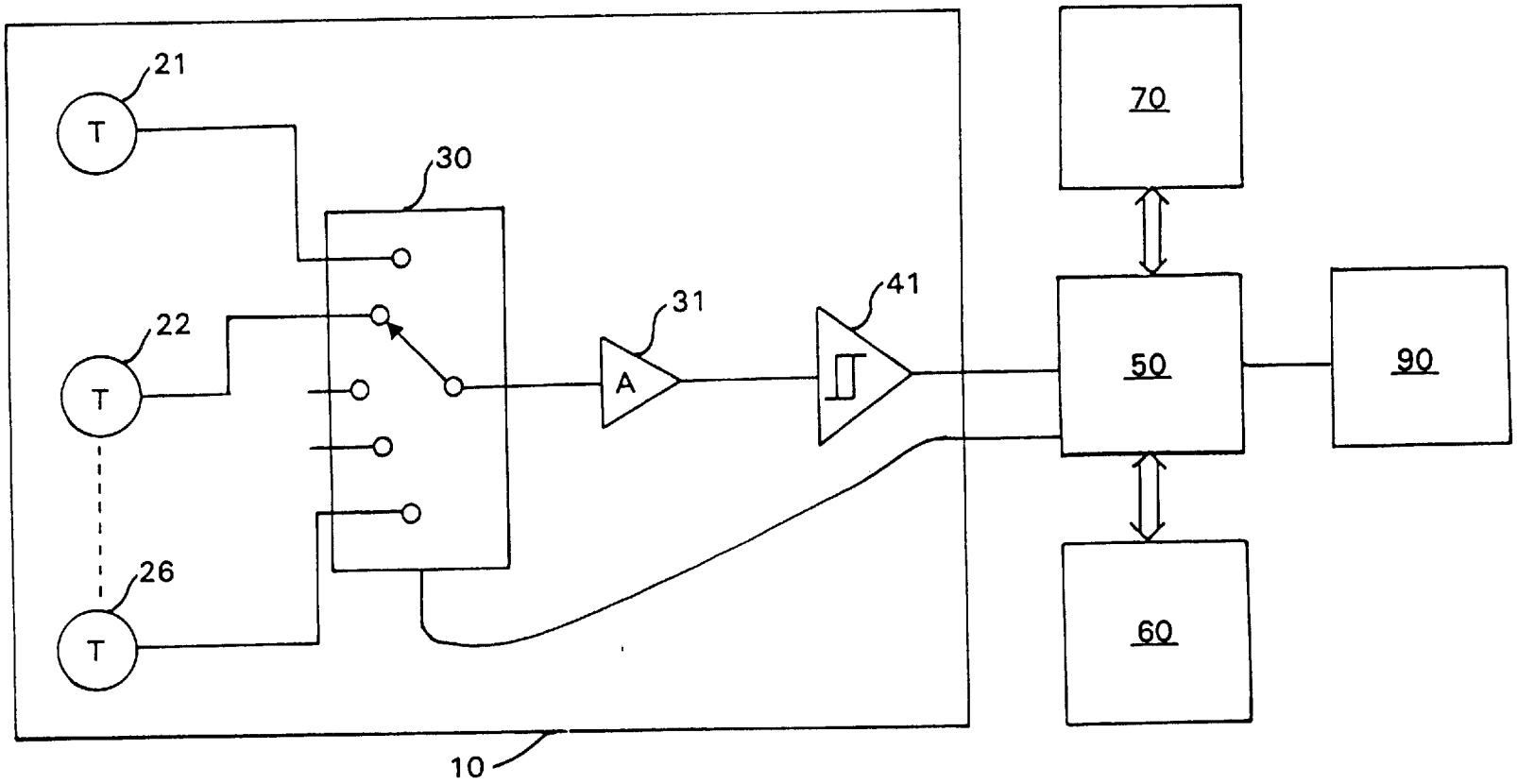
FIG. 3 shows a modification of the tuning system of FIG. 2 utilizing a selector switch.

In a first example, shown in FIG. 3, the multiple amplifiers 31–36 and Schmitt triggers 41–46 are replaced by a single amplifier 31 and Schmitt trigger 41 and a switching device 30. Switching device 30 is connected between transducers 21–26 and amplifier 31 and also connected to processor 50. In operation, switching device 30, under control of processor 50, sequentially connects amplifier 31 to one of transducers 21–26. Switching device 30 can be implemented as a solid-state analog switch or multiplexer module as well a mechanical switching device.

Figure 4:
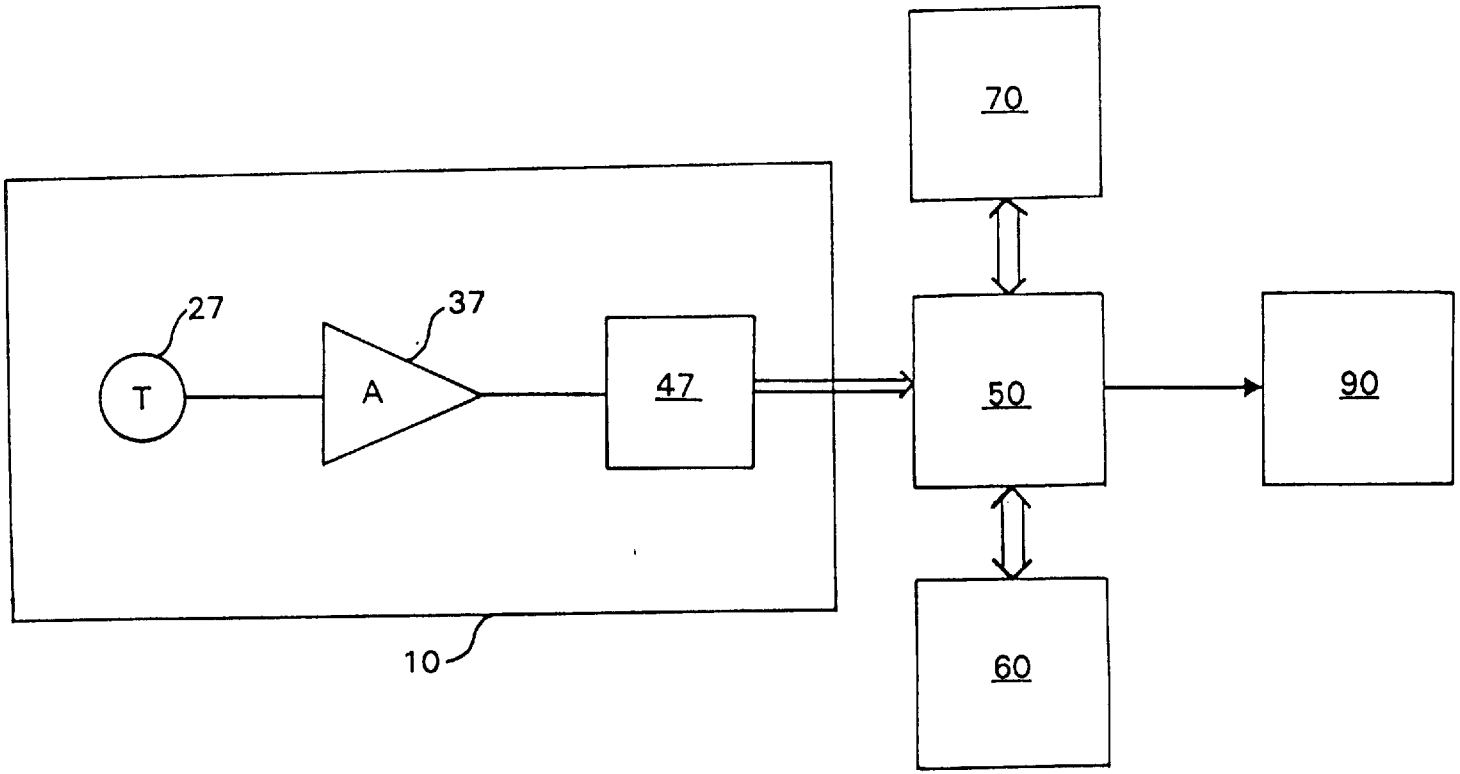
FIG. 4 is a modification of the tuning system of FIG. 2 utilizing a single transducer.

In a second example, shown in FIG. 4, a single transducer 27 is coupled to all strings in the instrument and provides a single analog electrical signal, representing the combined tones of all the strings, to amplifier 37. The amplified analog signal is digitized by analog-to-digital converter 47, then analyzed by processor 50 using a Fourier transform, or other processing algorithm, to provide frequency information for each of the vibrating strings.

In FIGS. 2–4, various transducer signal processing elements such as amplifiers, triggers, switches, and analog to digital converters are grouped as part of transducer 10. They can alternatively be considered part of processor 50.

Devices for providing a frequency signal include transducers sensitive to sound waves such as microphones, magnetic or electric field sensing devices coupled to vibrating elements of an instrument, optical sensors coupled to vibrating elements, and transducers sensitive to frequency-related phenomena such as strain gauges measuring tension in strings of stringed instruments. The term transducer is used herein for any device for providing a signal from which the frequency can be obtained, not limited to the examples cited above. The term transducer is used in the singular to refer to one or a plurality of devices coupled to the strings. Depending on the particular transducer, the coupling to the strings can be, for example, mechanical, electrical, optical, through sound waves, or through a magnetic field.

Schmitt triggers condition a transducer signal for use by a processor. The purpose of the conditioner is to convert an analog signal into a binary signal and to prevent edge slivers in the binary signal. Other signal conditioners can be employed, such as amplifiers, buffers, comparators, filters, and various forms of time delays and voltage level shifting.

Instrument condition sensors for detecting changes in operating conditions include force, pressure, and strain sensors for measuring string tension, thermistors for measuring temperature, various types of humidity sensors, current sensors for measuring electrical continuity or electrical contact between a string and a fret, and various types of electric or magnetic field sensing devices for detecting the presence of a string or capo.

Frequency measuring techniques include timers measuring the periods of signals, such as digital counters implemented in either hardware or software, or digital counters counting the number of cycles of a signal in a period of time. Other techniques include the use of Fourier transforms or other processing algorithms, analog or digital filters, and digital signal processors.

Various techniques for interconnecting functional blocks are also available to those skilled in the art. In addition to the usual wired connections are optical, ultrasonic, and radio links which permit remote location of portions of the tuning system.

Display devices include light emitting diodes (LEDs), fluorescent displays, various other forms of LCDs, and indicator lights.

Many of the previously named devices such as transducers, analog switches, amplifiers, buffers, comparators, filters, Schmitt triggers, delay lines and delay networks, counters, timers, multiplexers, optical couplers, and digital signal processors (DSPs) are available as off-the-shelf solid-state integrated circuits. Also readily available are application notes describing various configurations and applications of these devices to signal handling and processing. These devices and the techniques of using them are familiar to those having ordinary skill in the art of signal processing.

There are also many types of actuators adaptable to tuning an instrument, including electromechanical devices such as stepper motors, servo motors, linear motors, gear motors, leadscrew motors, piezoelectric drivers, shape memory metal motors, and various magnetic devices. Position reference devices for actuators include electrical contacts, optical encoders and flags, potentiometers, and mechanical stops for stepper motors. Many other types of apparatus will be obvious to those skilled in the art of control systems. A preferred embodiment includes the choice of an actuator which holds its position when power is removed; for example, a stepper motor or a gear ratio, leadscrew pitch, lever arm, or ramp with a critical angle such that if the motor produces no torque the tuning does not change. The motors can be connected to the strings by directly attaching a string to a motor shaft, or by various mechanical systems utilizing components such as gears, pulleys, springs and levers. The actuator can change the tension on the string by pulling along the axis of the string or by transverse deflection of the string. Many mechanical actuators for altering string tension have been described in the art. The control system of the present invention can be employed with any actuator. Each string can have more than one actuator attached to it, for example for coarse and fine control of the string frequency.

In tuning an instrument, the operator selects a predetermined tuning configuration from memory 60 using control panel 71 and display 72. Processor 50 then acquires a calibration function, which may be the default function or one selected by either the operator or the system, from memory 60 and uses it along with the selected target frequencies to compute the future actuator positions. These positions are then used to generate control signals which cause actuator 90 to move to the positions needed to produce the target frequencies.

A calibration procedure used in the preferred embodiment for a six-string guitar, using a second degree polynomial in f as a calibration function, is described in the following steps. In this procedure, 31 sets of frequency measurements are made at 31 sets of actuator positions: an initial position for all six actuators (one actuator tuning each string) and five additional positions for each of the six actuators. The procedure used in each of the 31 combinations of actuator positions is called a pass. At the beginning of each pass, the instrument is strummed. The strum can be performed by hand or with a mechanical strumming device. Following the strum, multiple frequency measurements are made for each string and the measurements are statistically analyzed to ensure a sufficiently precise value. When the six frequency values and six actuator position values have been obtained for each of the 31 passes, an analysis is performed to determine the coefficients of the calibration function for the conditions existing at the time of the calibration. The resulting coefficients are stored in memory as the definition of that one calibration function.

Figure 7:
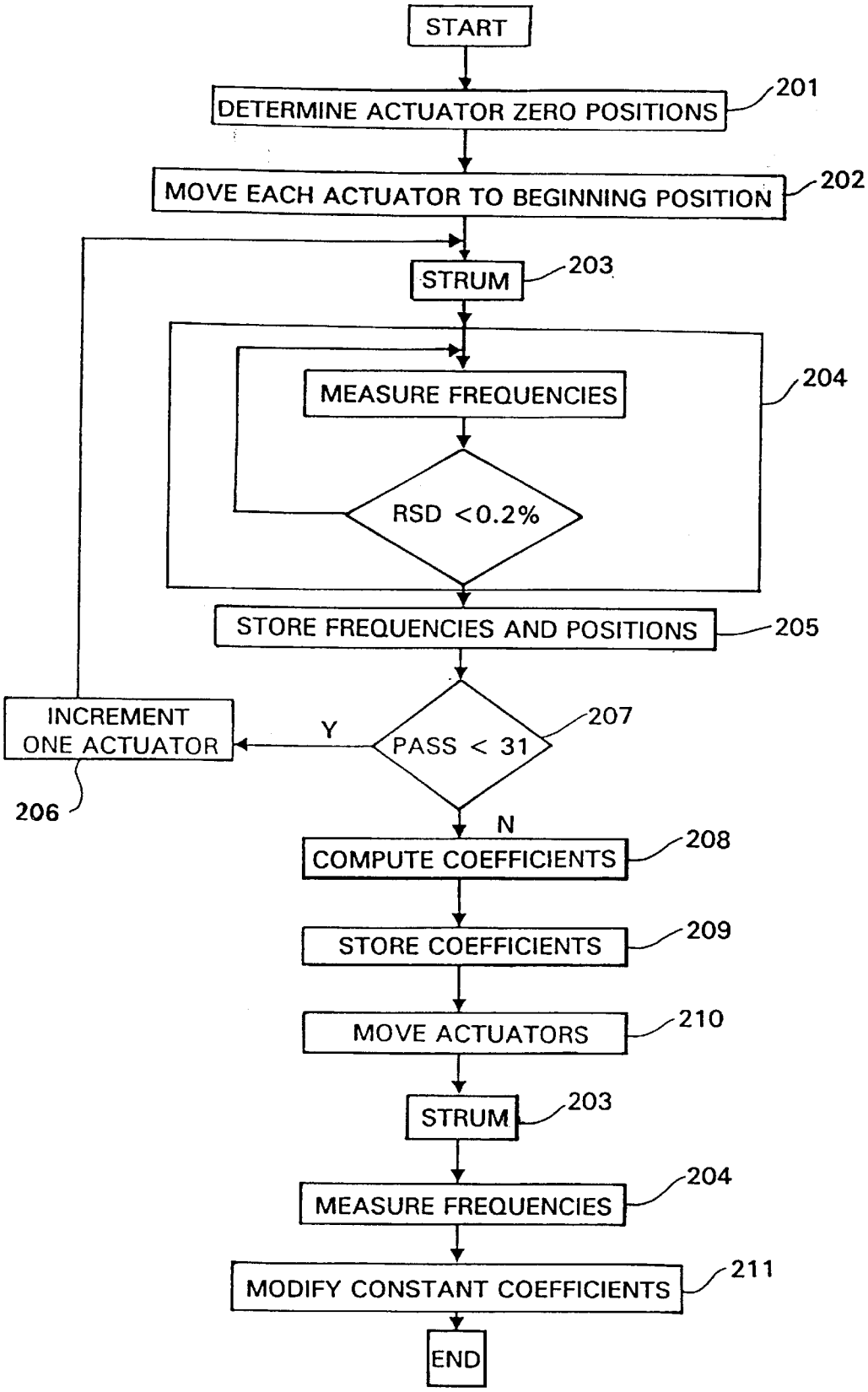
FIG. 7 is a flow chart of a calibration process used in the preferred embodiment.

The following calibration procedure is provided as but one example of a calibration procedure for a particular type of instrument to illustrate use of the invention in more detail. Many other possible procedures will be obvious to one of ordinary skill in the art. The following steps are illustrated in the flow chart of FIG. 7.

201. Each actuator moves to a position (for example, the low frequency end of its range) where an electrical contact specific to each actuator causes the processor to register each actuator position as the zero position for that actuator. Thereafter, the software will not allow any actuator to reach the zero position. The software also will not allow an actuator to reach the opposite end of its travel. Thus, the software prevents the mechanical system from jamming at either end of the range for each actuator under normal operation. After the zero position has been determined for a particular actuator, that actuator is moved up 100 steps to ensure that it is clear of the electrical contact; then, the process is repeated for the remaining actuators.

202. All actuators move to predetermined beginning positions. These positions are provided from memory and can be different for each set of strings. These positions may also represent the lower (frequency) end of the tuning range of each actuator.

203. Via the display, the processor requests that the operator mute the strings, then it waits until the transducers are not producing signals. When no signals are present, the processor requests that the operator strum the instrument, then it waits until the transducers are producing signals.

204. Each string frequency is repetitively measured and the measured values from each string are stored. While this is occurring, the display is provided with an indication of the pass number. When a running average of three frequency measurements for a string has reached a relative standard deviation (RSD) of 0.2%, that average is saved. When all strings have achieved 0.2% RSD, the pass is complete.

205. The current actuator positions and corresponding string frequencies are saved in a data set for later analysis.

206. One actuator is moved to its next position. The value to increment each actuator is also provided from memory and can be different for each set of strings. Any reasonable systematic method of moving one actuator at a time can be used. For example, the following order: actuator 1, actuator 2, . . . , actuator 6, actuator 1, actuator 2, . . . . The goal is to cover the operating space with enough independent data points to effectively describe the operational surface of the calibration function.

207. A total of 31 data sets are collected; until data set 31 is acquired, steps 203–207 are repeated.

208. After data set 31 has been recorded, a mathematical analysis is performed, using a standard least squares regression algorithm producing the coefficients for a system of equations which gives the position of each actuator as a function of all string frequencies. Using the resulting coefficients, collectively defining a calibration function, the processor can predict the position required of each actuator to produce any given set of target frequencies within system range for that set of conditions.

209. The coefficients are stored for later use.

210. The actuators are moved to their Standard Tuning (EADGBE) positions, obtained by inserting the target frequencies of the six Standard Tuning notes from memory into the system of equations and computing the position values.

203. Via the display, the processor requests that the operator mute the strings, then it waits until the transducers are not producing signals. When no signals are present, the processor requests that the operator strum the instrument, then it waits until the transducers are producing signals.

204. Each string frequency is repetitively measured and the measured values from each string are saved. When a running average of three frequency measurements for a string has reached a relative standard deviation (RSD) of 0.2%, that average is saved and the status is provided to the display. When all strings have achieved 0.2% RSD, the frequency measurement is complete.

211. The resulting measured frequency values are used to adjust the constant coefficients in the system of equations. This step is known as a "system touch-up at Standard Tuning" or a "Standard Touch". It is different from all other touch-ups because this touch-up actually adjusts the constant terms in the system of equations. If something happens to the instrument such as a temperature rise or fall on an outdoor stage, or one or more strings stretch during play, the effect will be relatively the same for all target frequencies in the system. Thus, the correction is applied to the entire system of equations at once by modifying the stored constant terms.

The calibration is now complete.

Figure 8:
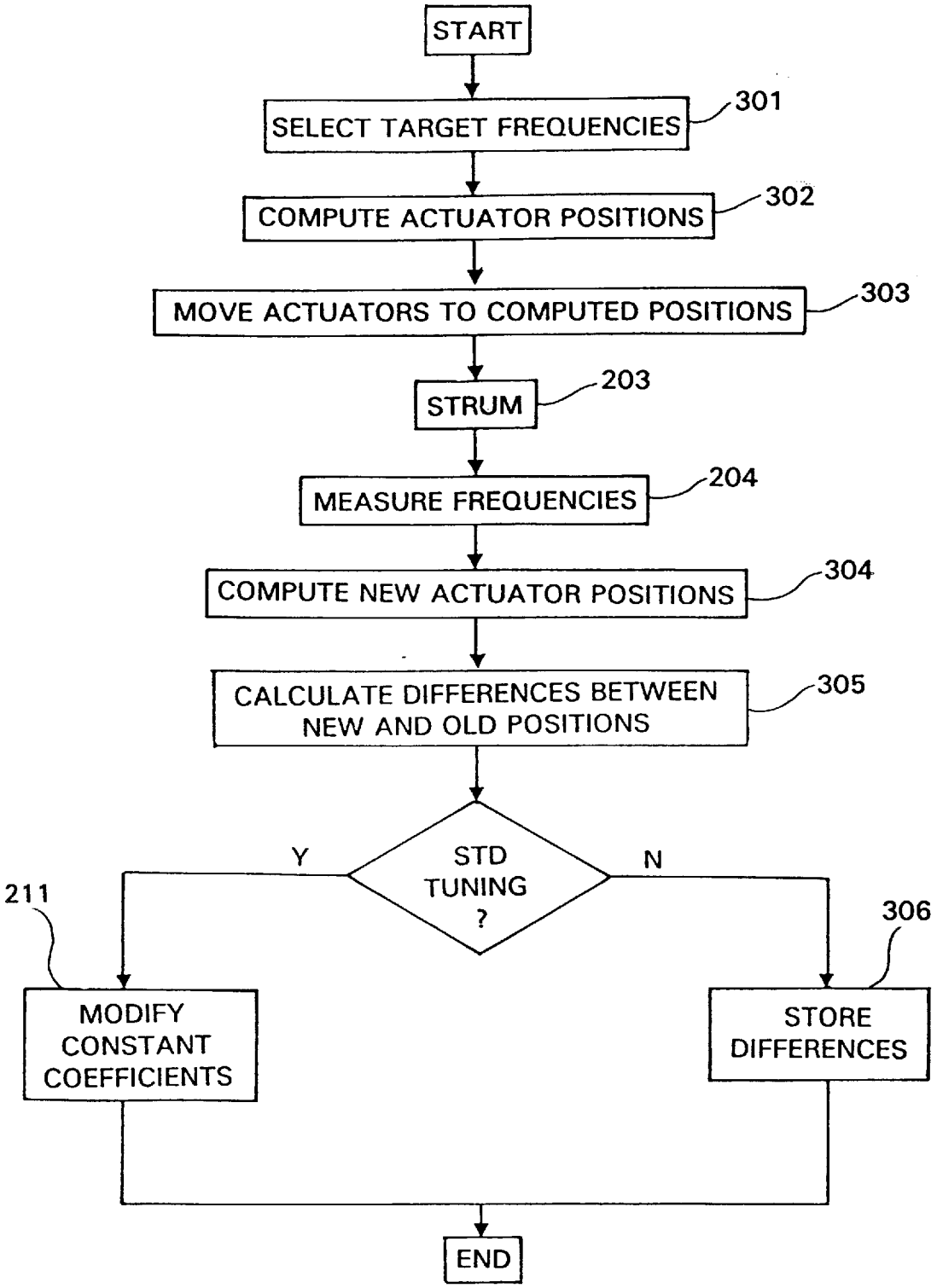
FIG. 8 is a flow chart of a "touch-up" calibration process used in the preferred embodiment.

A modification or "touch-up" of a tuning is done when only slight changes in the characteristics of an instrument have occurred and a complete recalibration is either unnecessary or too time consuming. For example, a touch-up may be needed when a temperature change has occurred (unless the calibration library includes a calibration function corresponding to the changed characteristics). A major advantage of the touch-up technique is that it requires only a single strum of the instrument. A touch-up procedure is described in the following steps and depicted in the flow chart of FIG. 8.

301. A set of target frequencies is selected by the operator, using an input mechanism such as switch panel 71. The processor then acquires the selected target frequencies from memory.

302. A set of actuator positions is computed by inserting the target frequencies for this tuning configuration into the calibration function for the current set of conditions.

303. All actuators are moved to their respective positions computed in the preceding step.

304. The current measured frequency values are inserted into the calibration function and new actuator positions are computed using the current frequency values.

305. The differences between the new actuator positions and the previous actuator positions are computed.

306. The differences are stored, with reference to the original calibration function, to be subtracted from the actuator positions predicted for this set of target frequencies whenever the tuning configuration is requested again with the same calibration function. In the case of a "Standard Touch" the constant terms in the calibration function are modified, as stated in step 211.

The touch-up modification is now complete.

In general, calibration functions can be created by theoretical or empirical methods, or both, and stored as coefficients of functions or as look-up tables. Calibration functions can be generated at the factory and shipped with the system or generated by the operator in the field. The term factory-generated calibration refers to calibration of an instrument which is performed by the control system manufacturer or installer, the instrument manufacturer, or anyone other than the operator. The factory calibration can be performed on the individual instrument on which the control system is installed or it can be performed on a reference instrument, for example one of the same model, and the calibration functions can be transferred from one control system to another. Systems may be shipped with some factory calibration functions and then have others added by the operator. Also, systems may be shipped with factory calibration functions and only need touch-up calibration in the field. In any case, in the preferred embodiment, each calibration function is created by using a procedure such as described above while the instrument is in the particular configuration or environment for which that calibration function is desired. As each calibration function is created, it is indexed and stored for later use.

While the invention has been described above with respect to specific embodiments, it will be understood by those of ordinary skill in the art that various changes in form and details may be made therein without departing from the spirit and scope of the invention which receives definition in the following claims.

We claim:

1. A control system for an automatically tuned stringed instrument, said instrument having a plurality of strings, each string having an actuator connected thereto, comprising:

a memory for storing; and a processor coupled to said memory and adapted to be coupled to the actuators, said processor including means for addressing said memory to retrieve one of said calibration functions from said memory, means for generating control signals in accordance with the retrieved calibration function, and means for outputting said control signals to said actuators.

2. The control system of claim 1 wherein each of said calibration functions relates the actuator position for a given string to the frequency of said given string.

3. The control system of claim 2 wherein each of said calibration functions relates the actuator position for a given string to the frequency to the first power and the frequency squared of said given string.

4. The control system of claim 2 wherein each of said calibration functions relates the actuator position for a given string to the frequencies of each of said plurality of strings.

5. The control system of claim 4 wherein each of said calibration functions relates the actuator position for a given string to the frequencies to the first power and the frequencies squared of each of said plurality of strings.

6. The control system of claim 1 wherein said instrument can be tuned in a plurality of different instrument conditions and wherein said plurality of calibration functions comprises different calibration functions for different instrument conditions.

7. The control system of claim 6 wherein one of said calibration functions is for an instrument condition having a broken string.

8. The control system of claim 7 wherein a second of said calibration functions is for an instrument condition having more than one broken string.

9. The control system of claim 7 wherein said stringed instrument has j strings and wherein said plurality of calibration functions comprises j calibration functions, one for each instrument condition having one of said j strings broken.

10. The control system of claim 6 wherein the different instrument conditions comprise conditions with different sets of string types.

11. The control system of claim 6 wherein said different instrument conditions comprise conditions with environments having different humidities.

12. The control system of claim 6 wherein said different instrument conditions comprise conditions with environments having different temperatures.

13. The control system of claim 6 wherein said stringed instrument is a fretted stringed instrument and wherein one of said calibration functions is for an instrument condition having a capo installed on one fret.

14. The control system of claim 13 wherein said plurality of calibration functions comprises a different calibration function for each different fret upon which a capo can be installed.

15. The control system of claim 6 wherein said different instrument conditions are selected from the group consisting of (a) a broken string, (b) different sets of string types, (c) environments having different humidities and (d) environments having different temperatures.

16. The control system of claim 6 wherein said stringed instrument is a fretted stringed instrument and wherein said different instrument conditions are selected from the group consisting of (a) a broken string, (b) different sets of string types, (c) environments having different humidities, (d) environments having different temperatures, and (e) a capo installed on one fret.

17. The control system of claim 16 wherein said different instrument conditions comprise more than one member of said group of instrument conditions.

18. The control system of claim 16 wherein said different instrument conditions comprise simultaneous combinations of more than one member of said group of instrument conditions.

19. The control system of claim 1 adapted for use with an instrument condition sensor, coupled to said processor, wherein said processor selects which of said calibration functions to retrieve from said memory based on input from said instrument condition sensor.

20. The control system of claim 19 wherein said instrument condition sensor is adapted to sense a broken string.

21. The control system of claim 20 wherein said condition sensor comprises a transducer coupled to said strings and wherein said processor is adapted to receive a transducer signal from said transducer, and wherein said processor detects a broken string from said transducer signal.

22. The control system of claim 20 wherein said condition sensor comprises a means for monitoring the electrical continuity of the strings.

23. The control system of claim 20 wherein said condition sensor comprises a means for monitoring the tension of the strings.

24. The control system of claim 19 wherein said instrument condition sensor is adapted to sense the type of string.

25. The control system of claim 19 wherein said instrument condition sensor is adapted to sense the humidity of the environment.

26. The control system of claim 19 wherein said instrument condition sensor is adapted to sense the temperature of the environment.

27. The control system of claim 19 wherein said stringed instrument is a fretted stringed instrument and wherein said instrument condition sensor is adapted to sense an installed capo on one of the frets.

28. The control system of claim 27 wherein said condition sensor comprises a transducer coupled to said strings, and wherein said processor is adapted to receive a transducer signal from said transducer, and wherein said processor comprises means for detecting an installed capo from said transducer signal.

29. The control system of claim 27 wherein said condition sensor comprises a means for detecting electrical contact between a string and a fret.

30. The control system of claim 1 further including an operator interface coupled to said processor, for receiving operator input from an instrument operator.

31. The control system of claim 30 wherein said processor selects which of said calibration functions to retrieve from said memory based on operator input from said operator interface.

32. The control system of claim 31 wherein said operator input indicates the type of string.

33. The control system of claim 31 wherein said operator input indicates a broken string.

34. The control system of claim 33 adapted for use with an instrument condition sensor, coupled to said processor, wherein said instrument condition sensor is adapted to sense which of said plurality of strings is broken.

35. The control system of claim 34 wherein said condition sensor comprises a transducer and wherein said processor is adapted to receive a transducer signal from said transducer, and wherein said processor detects a broken string from said transducer signal.

36. The control system of claim 31 wherein said operator input indicates an installed capo.

37. The control system of claim 36 adapted for use with an instrument condition sensor, coupled to said processor, wherein said instrument condition sensor is adapted to sense on which fret said capo is installed.

38. The control system of claim 37 wherein said condition sensor comprises a transducer, and wherein said processor is adapted to receive a transducer signal from said transducer, and wherein said processor comprises means for obtaining the measured frequency of each of said plurality of strings from said transducer signal, and wherein said processor detects an installed capo by obtaining the ratio of said measured frequency to the open-string frequency.

39. The control system of claim 30 wherein said operator interface further comprises means for displaying instrument conditions to said instrument operator.

40. The control system of claim 1 wherein said memory contains at least one factory-generated calibration function.

41. The control system of claim 40 wherein said memory contains a plurality of factory-generated calibration functions.

42. The control system of claim 41 wherein said stringed instrument is a fretted stringed instrument and wherein said plurality of factory generated calibration functions are for different instrument conditions, said different instrument conditions selected from the group consisting of (a) a broken string, (b) different sets of string types, (c) environments having different humidities, (d) environments having different temperatures, and (e) a capo installed on one fret.

43. The control system of claim 1 wherein said instrument has a transducer and wherein said processor is adapted to receive a transducer signal from said transducer and wherein said processor comprises means for obtaining the measured frequency of each of said plurality of strings from said transducer signal.

44. The control system of claim 43 wherein said processor further comprises means for generating a calibration function.

45. The control system of claim 44 wherein said means for generating a calibration function comprises means for acquiring $f_k$ and $x_k$, the measured frequency and actuator positions, respectively, for a given string at a plurality, k, of actuator positions, and means for generating therefrom a function relating x to f.

46. The control system of claim 44 wherein said means for generating a calibration function comprises means for acquiring $f_{jk}$ and $x_{jk}$, the measured frequency and actuator positions, respectively, for j strings, each string at a plurality, k, of actuator positions, and means for generating therefrom a function relating $x_j$ for a given actuator j to $f_j$ for all j strings.

47. The control system of claim 43 wherein said processor further includes modifying means for modifying a calibration function.

48. The control system of claim 47 wherein said calibration function is modified by a function of the difference between the measured frequency of a given string and the target frequency of said string.

49. The control system of claim 47 wherein said calibration function is modified by a function of the difference between the actuator position computed for the target frequency of a given string and the actuator position computed for the measured frequency of said string.

50. The control system of claim 47 wherein said modifying means comprises a closed-loop system.

51. The control system of claim 1 wherein each of said calibration functions can be used to calculate target actuator positions for a plurality of sets of target frequencies.

52. The control system of claim 1 adapted to be installable in a plurality of different instruments, wherein said plurality of calibration functions comprises a different calibration function for each of said different instruments.

53. The control system of claim 52 wherein said different instruments include instruments which differ in string length.

54. The control system of claim 52 wherein said different instruments include instruments which differ in body material.

55. The control system of claim 52 wherein said different instruments include instruments which differ in actuator type.

56. The control system of claim 52 wherein said different instruments include instruments which differ in instrument type.

57. The control system of claim 52 wherein said plurality of calibration functions comprises a plurality of calibration functions for each of said different instruments.

58. An automatically tuned stringed instrument, comprising:

a plurality, j, of strings;

a plurality, j, of actuators, one of said actuators connected to each of said strings;

a memory for storing a plurality of calibration functions; and a processor coupled to said memory and to said actuators, for retrieving one of said calibration functions from said memory, for generating a control signal in accordance with said retrieved calibration function, and for transmitting said control signal to said actuators.

59. The instrument of claim 58 wherein each of said calibration functions relates the actuator position for a given string to the frequencies of each of said plurality of strings.

60. The instrument of claim 58 wherein said instrument can be tuned in a variety of different instrument conditions and wherein said plurality of calibration functions comprises different calibration functions for different instrument conditions.

61. The instrument of claim 60 wherein one of said calibration functions is for an instrument condition having a broken string.

62. The instrument of claim 60 wherein the different instrument conditions comprise conditions with different sets of string types.

63. The instrument of claim 60 wherein said different instrument conditions comprise conditions with environments having different humidities.

64. The instrument of claim 60 wherein said different instrument conditions comprise conditions with environments having different temperatures.

65. The instrument of claim 60 wherein said stringed instrument is a fretted stringed instrument and wherein one of said calibration functions is for an instrument condition having a capo installed on one fret.

66. The instrument of claim 58 further comprising an instrument condition sensor, coupled to said processor, wherein said processor selects which of said calibration functions to retrieve from said memory based on input from said instrument condition sensor.

67. The instrument of claim 58 further including an operator interface coupled to said processor, for receiving operator input from an instrument operator.

68. The instrument of claim 67 wherein said processor selects which of said calibration functions to retrieve from said memory based on operator input from said operator interface.

69. The instrument of claim 67 wherein said operator interface further comprises means for displaying instrument conditions to said instrument operator.

70. The instrument of claim 58 wherein said memory contains a plurality of factory-generated calibration functions.

71. The instrument of claim 70 wherein said stringed instrument is a fretted stringed instrument and wherein said plurality of factory generated calibration functions are for different instrument conditions, said different instrument conditions selected from the group consisting of (a) a broken string, (b) different sets of string types, (c) environments having different humidities, (d) environments having different temperatures, and (e) a capo installed on one fret.

72. The instrument of claim 58 further comprising a transducer coupled to said processor and wherein said processor comprises means for obtaining the measured frequency of each of said plurality of strings from the transducer signal.

73. The instrument of claim 72 wherein said processor further comprises means for generating a calibration function.

74. The instrument of claim 73 wherein said means for generating a calibration function comprises means for acquiring $f_k$ and $x_k$, the measured frequency and actuator positions, respectively, for a given string at a plurality, k, of actuator positions, and means for generating therefrom a function relating x to f.

75. The instrument of claim 73 wherein said means for generating a calibration function comprises means for acquiring $f_{jk}$ and $x_{jk}$, the measured frequency and actuator positions, respectively, for j strings, each string at a plurality, k, of actuator positions, and means for generating therefrom a function relating $x_j$ for a given actuator j to $f_j$ for all j strings.

76. The instrument of claim 72 wherein said processor further includes modifying means for modifying a calibration function.

77. The instrument of claim 76 wherein said calibration function is modified by a function of the difference between the measured frequency of a given string and the target frequency of said string.

78. The instrument of claim 76 wherein said calibration function is modified by a function of the difference between the actuator position computed for the target frequency of a given string and the actuator position computed for the measured frequency of said string.

79. The instrument of claim 58 wherein each of said calibration functions can be used to calculate target actuator positions for a plurality of sets of target frequencies.

80. A method for tuning a stringed instrument, said instrument having a plurality of strings, each string having an actuator connected thereto, said instrument further having a memory for storing a plurality of calibration functions, and a processor coupled to said memory and to said actuators, said method comprising the steps of:

transferring one of said calibration functions from said memory to said processor;

generating within said processor a control signal in accordance with said transferred calibration function; and transmitting said control signal to said actuators, whereby said actuators modify the frequencies of said strings.

* * * * *

UNITED STATES PATENT AND TRADEMARK OFFICE

CERTIFICATE OF CORRECTION

PATENT NO. : 5,824,929

DATED : October 20, 1998

INVENTOR(S) : Freeland et al.

It is certified that error appears in the above-identified patent and that said Letters Patent is hereby corrected as shown below:

In the claims:

In Claim 1, Col. 15, line 31, after "storing" insert --a plurality of calibration functions--

Signed and Sealed this

Twenty-fifth Day of May, 1999

*Attest:*

Q. TODD DICKINSON

*Attesting Officer*

*Acting Commissioner of Patents and Trademarks*